US011118878B2

(12) United States Patent
Albanese

(10) Patent No.: US 11,118,878 B2
(45) **Date of Patent: *Sep. 14, 2021**

(54) APPARATUS AND METHOD FOR BROADHEAD ARCHERY

(71) Applicant: Nicola Albanese, Flemington, NJ (US)

(72) Inventor: Nicola Albanese, Flemington, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/788,351

(22) Filed: Feb. 12, 2020

(65) Prior Publication Data

US 2020/0173760 A1 Jun. 4, 2020

Related U.S. Application Data

(63) Continuation-in-part of application No. 16/205,656, filed on Nov. 30, 2018, now Pat. No. 10,921,102.

(51) Int. Cl.
*F42B 6/08* (2006.01)

(52) U.S. Cl.
CPC ..... *F42B 6/08* (2013.01)

(58) Field of Classification Search
CPC ..... F42B 6/08; F42B 6/04
See application file for complete search history.

(56) References Cited

U.S. PATENT DOCUMENTS

| | | | | |
|---|---|---|---|---|
| 2,304,705 | A | 1/1940 | Pate | |
| 2,684,852 | A * | 7/1954 | Romeka | F42B 6/08 473/583 |
| 3,036,396 | A * | 5/1962 | Swails | F42B 6/08 43/6 |
| 4,915,278 | A | 4/1990 | Smith | |
| 4,985,932 | A | 1/1991 | Bezdek | |
| 5,551,615 | A | 9/1996 | McIntosh | |
| 5,724,225 | A | 3/1998 | Hrusoff et al. | |
| 6,296,165 | B1 | 10/2001 | Mears | |
| 7,713,152 | B1 * | 5/2010 | Tentler | F42B 6/08 473/583 |
| 7,806,305 | B1 | 10/2010 | Moore, Jr. et al. | |
| 8,157,137 | B1 | 4/2012 | Laird | |
| 2004/0195144 | A1 | 10/2004 | Smith | |
| 2007/0037640 | A1 * | 2/2007 | Rager | F42B 6/08 473/578 |
| 2010/0004078 | A1 * | 1/2010 | Flanagan | F42B 6/08 473/583 |
| 2014/0128186 | A1 * | 5/2014 | Treto | F42B 6/08 473/583 |

* cited by examiner

*Primary Examiner* — Jeffrey S Vanderveen
(74) *Attorney, Agent, or Firm* — Thomas Adams

(57) ABSTRACT

Archery apparatus for broadheads includes a tip with a plurality of edges adapted to penetrate hard tissue. The tip is located on the forward end of a body. The body can be mounted on an arrow shaft. A plurality of articulating blades are pivotally mounted on the body to swing between an extended position and a backwardly folded position. One or more fixed blades are mounted on the body behind the articulating blades. A resilient device can keep the articulating blades in the extended position during unimpeded flight, but will allow the articulating blades to fold backwardly while encountering hard tissue in a target. The articulating blades extend outwardly after passing by the hard tissue.

6 Claims, 6 Drawing Sheets

APPARATUS AND METHOD FOR BROADHEAD ARCHERY

BACKGROUND OF THE INVENTION

1. Field of the Invention

The present invention relates to archery and, in particular, to broadheads having articulating blades.

2. Description of Related Art

Hunting with a bow and arrow is a popular sport. On the other hand, primitive arrows are not very lethal and can inflict pain and extended suffering.

With this in mind, arrowheads with large, angularly spaced blades are used for their ability to produce a large wound that causes the game animal to bleed out quickly. Arrowheads with these large blades are referred to as broadheads. Some jurisdictions require that the blades of broadheads have a minimum tip to tip dimension to enhance lethality and avoid painful, lingering injuries Broadheads can be rendered relatively ineffective if they first strike a bone. For this reason, some arrowheads have a tip with multiple ridges designed to shatter bone. However, even if this tip manages to fracture the obstructing bone, the broad blades behind the tip will have difficulty penetrating past the bony structure.

One type of broadhead has a number of blades pivotally mounted on the arrowhead and folded down during flight with their tips pointing forward. When penetrating a target, the forward tips of the blades are pushed back to extend the blades in order to produce a large puncture wound.

Other, so called "mechanical" broadheads, are launched with their blades folded back into, a retracted position. A slider on the assembly can be driven backwardly on impact to unlatch the blades so they can swing outwardly. This arrangement can be unreliable since the outward swinging operation must occur extremely quickly and against forces that would normally drive the blades backward. Also, these mechanisms have used double springs: one to facilitate the release latch, and another to swing the blades outwardly.

Some arrows have a tubular shaft containing a sliding weight that is initially held at the rear end of the arrow shaft. When the arrow strikes a target and rapidly decelerates, the sliding weight continues to move forward and strikes the back of the arrowhead to drive it deeper into the target.

U.S. Pat. No. 8,182,238 has a leaf spring that fits into a slot on a pivotable blade to allow a slight retraction when the blade hits an obstruction. When pulling the assembly out of a target, this blade can swing forward as the leaf spring pops out of the blade's slot. Resetting the blade for reuse is problematical since the user is expected to handle the blade and risk getting cut. Also resetting the blade is difficult since the leaf spring does not simply return to the slot and the user must disassemble the spring mechanism.

See also U.S. Pat. Nos. 2,289,284; 4,976,443; 5,102,147; 6,258,000; 6,375,586; 6,517,454; 6,669,586; 8,241,157; and 8,992,354; as well as US Patent Application Pub. No. 2006/0160642.

SUMMARY OF THE INVENTION

In accordance with the illustrative embodiments demonstrating features and advantages of the present invention, there is provided apparatus for broadhead archery. The apparatus includes a tip with a plurality of edges adapted to penetrate hard tissue. The apparatus also includes a body with a forward end and an aft end. The tip is located on the forward end. The apparatus includes a plurality of articulating blades pivotally mounted on the body to swing between an extended position and a backwardly folded position. Also included is a resilient device for keeping the plurality of articulating blades in the extended position during unimpeded flight and for allowing the articulating blades to fold backwardly while encountering hard tissue in a target. The apparatus also includes one or more fixed blades mounted on the body behind the plurality of articulating blades.

In accordance with another aspect of the invention, an archery method is provided. The method employs an arrow having a plurality of articulating blades mounted on a body in front of one or more fixed blades and behind a multi-edged tip. The method includes the step of launching the arrow with the plurality of articulating blades articulated to extend outwardly during unimpeded flight. The method also includes the step of folding the plurality of articulating blades backwardly upon encountering hard tissue. The method also includes the step of extending the plurality of articulating blades outwardly after passing by the hard tissue.

By employing apparatus and methods of the foregoing type, an improved broadhead and archery technique is achieved. In a disclosed embodiment, a ferrule has a rear threaded stud designed to screw into an arrow shaft. Threaded into the front of this ferrule is a tapered steel tip with a number of tapered flutes providing sharp edges designed to shatter or fragment bone on impact.

In this embodiment, a single rear blade is fitted into a slot that traverses a rear section of the ferrule. This rear blade extends outwardly from opposite sides of the ferrule. The tip to tip expanse of the rear blade can be made sufficiently large to satisfy any requirement that the broadhead have sufficient width to humanely dispatch the game animal.

This embodiment has a parallel pair of articulating blades that are pivotally mounted on a common axle traversing the body of the ferrule. The blades project through slots on opposite sides of the ferrule. Under certain circumstances, the blades will fold backwardly to reside more deeply inside the foregoing slots.

The disclosed ferrule has longitudinal bore containing a steel ball that is biased forwardly from behind by a helical spring. The disclosed ball bears against the inside edges of the blades, which edges act as camming surfaces for driving the blades outwardly. The outside edges of the blades are sharpened to act as cutting edges.

In another disclosed embodiment, a torsion spring is used to extend the articulating blades. In one case, the torsion spring has a helical winding positioned around an axle that pivotally supports the articulating blades. In another case, the helically wound spring is positioned to the rear of the articulating blades. In either case, the torsion spring has a pair of arms that engage the articulating blades to outwardly urge them. In still another embodiment, a bow spring in the form of a V shaped wire has arms that connect to the articulating blades to outwardly urge them.

In these embodiments, the articulating blades are outwardly biased into an extended position during unimpeded flight of the arrow.

If the arrow encounters hard tissue (e.g. bone) at a target, the sharp edges of the tapered tip can strike and shatter the hard tissue. Significantly, the overall width or outside diameter of the disclosed tip is greater than that of the ferrule. Thus, the tip will provide a tunnel that facilitates penetration into the target.

When the articulating blades encounter hard tissue, they will be forced back and will fold into the slots on the opposite sides of the ferrule. Accordingly, the folded blades can readily pass through the target. After passing by the hard tissue the disclosed spring mechanism will urge the blades outwardly again, which will increase the cutting power of the arrow.

The disclosed arrangement avoids the disadvantages of "mechanical" broadheads, in that the disclosed blades are fully deployed during flight, and need not swing outwardly on impact. Also, the disclosed mechanism works with a single spring to reduce weight, and enhance effectiveness and reliability. In addition, the disclosed arrangement is easily reused without the need to disassemble the mechanism or manipulate the blades and risk injury.

The disclosed spring mechanism may have a safety feature that prevents damage to the articulating blades. When encountering hard tissue such as a rib, moderate force is applied to the blade, which folds quickly. If the blade encounters tissue that is extremely hard (e.g. a femur), an extreme force is instantaneously applied through the blade to the spring mechanism. The spring in this mechanism will quickly compress while sustaining extreme force. As a result, the spring will undergo inelastic deformation, which will limit the amount of force that the spring can offer. While this deformation sacrifices the spring, it is important to avoid breaking off the blades, which can lodge in the animal causing a non-lethal wound leading to extended suffering.

The overall effectiveness of the arrow will be enhanced if all of its kinetic energy can be initially applied through the cutting edges of the tip. Applying high amounts of energy through the tip enhances the ability to shatter bone and allow deep penetration of the arrow. However, the energy available at the tip can be degraded if portions of the arrow behind the tip produce a drag. Accordingly, disclosed embodiments of the arrow have rearward portions that are relatively narrow and can easily pass through a target without producing drag that saps the energy available at the tip.

In a disclosed embodiment a tip has a number of circumferentially spaced flutes formed with cutting edges between them. The flutes originate at a common point and diverge rearwardly from that point to form slanted scoops that end in a scalloped border. Beyond the scalloped border the tip has an inwardly tapered skirt. This skirt has a crown-like shape, that is, a flared waist with multiple peaks. The inward tapering of the skirt eliminates unnecessary drag beyond the cutting edges of the tip. In fact, the cutting edges of the tip produce a passage through which the skirt can easily pass. Accordingly, energy is not diverted from the cutting edges of the tip.

In this embodiment, the tip is attached to a ferrule that has a rear section with at least one fixed blade, and a forward section with a number of articulating blades. Both the forward and the rear sections, as well as a midsection between them, have a width (not counting the blades) that is less than the maximum width of the tip. Again, the tip provides a passage through which the ferrule easily passes without creating a frictional drag that diverts energy from the cutting edges of the tip or from the blades on the forward and the rear sections of the ferrule. In fact, to eliminate frictional drag more effectively, the midsection and the rear section of the ferrule have a smaller diameter than the forward section, and can therefore pass easily through the passage produced by the tip and by the forward section.

Aerodynamic drag is also a factor to be considered before the broadhead penetrates a target. For this reason, the disclosed tip flares outwardly to a rear border to cause an airflow that reduces aerodynamic drag on the narrower body lying past the tip.

As described further hereinafter, the tip on the broadhead can be interchanged with other tips to allow an archer to change characteristics of the tip, such as the width and the number of cutting edges. In addition, the tip can be selected to have a desired "weight forward." In general, a heavier tip will increase the weight forward and enhance the punch delivered by the broadhead.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
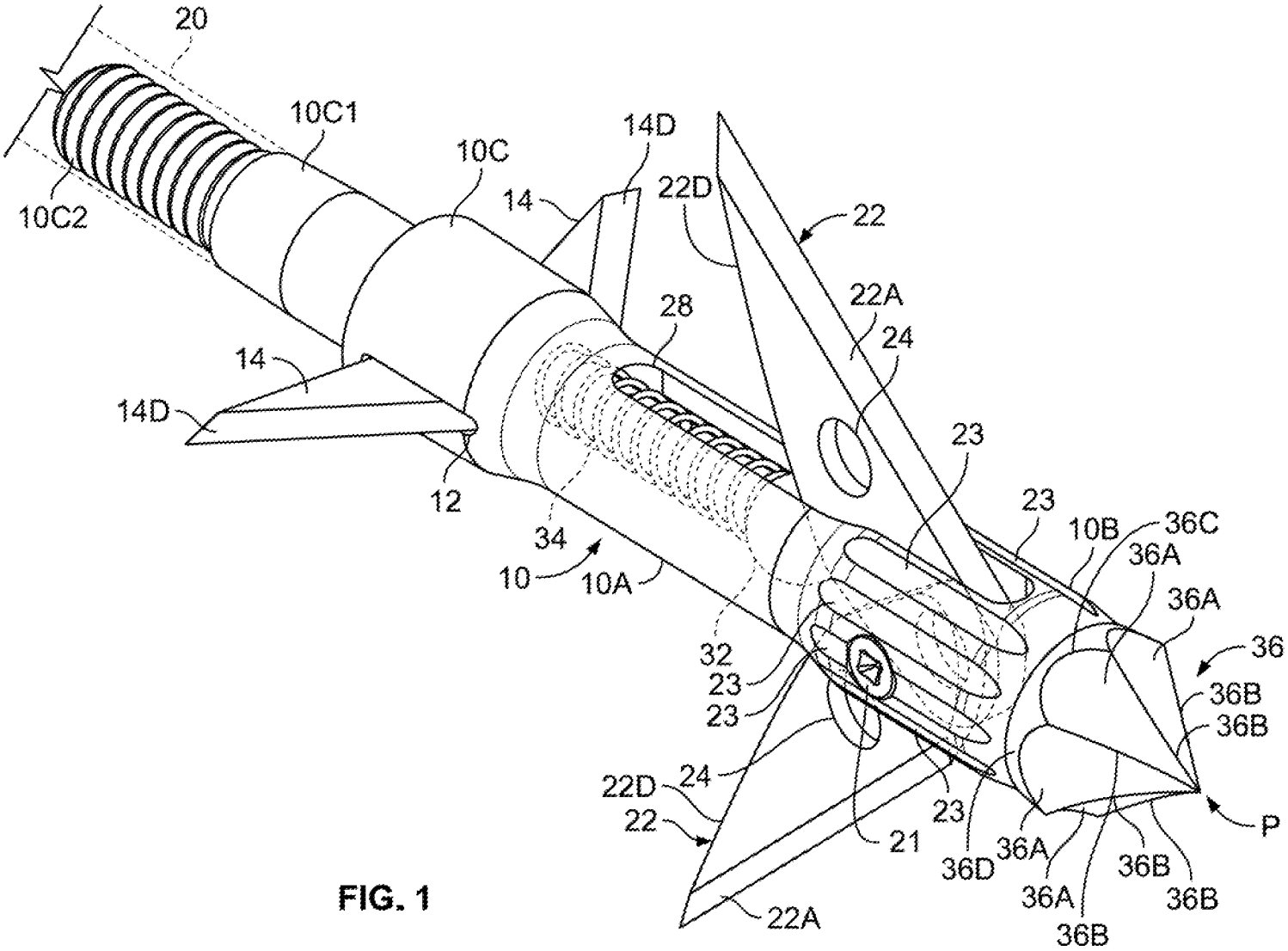
FIG. 1 is a perspective view of broadhead apparatus employing articulating blades in accordance with principles of the present invention.

Referring to FIGS. 1-7, the illustrated apparatus is used for broadhead archery, that is, archery using a broadhead. The apparatus has a body 10 shown as a ferrule with a midsection 10A, a forward section 10B, and rear section 10C. Rear section 10C includes a round stud 10C1 having a reduced diameter and connecting to threaded shaft 10C2. Shaft 10C2 is at the aft end of the body 10 and is designed to screw into the main arrow shaft 20 (which together with body 10 and its attachments constitute the rest of the arrow). Forward section 10B has ten flutes 23, five on one side, and five on the opposite side.

The overall length of body 10 is 1.34 inches, excluding sections 10C1 and 10C2. Forward section 10B is slightly wider than the other sections of body 10 and is about 0.30 inch in diameter at its widest location. It will be appreciated that the foregoing dimensions are exemplary, and other embodiments may employ different dimensions.

Rear section 10C has a transverse slot 12 holding a fixed blade 14. In this embodiment blade 14 is a single blade, although other embodiments may use more than one fixed blade. Fixed blade 14 is essentially a flat plate except for beveled, sharpened edges 14D. Blade 14 has a spaced pair of weight-reducing holes 16 (FIG. 2).

Figure 2:
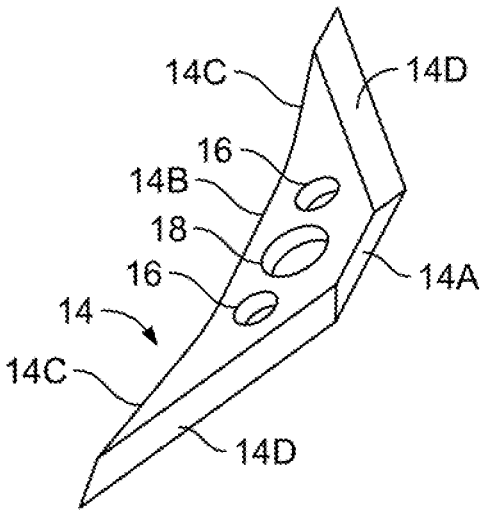
FIG. 2 is a perspective view of the fixed blade of FIG. 1.

As shown in FIG. 2, blade 14 has a forward face 14A that is parallel to rear face 14B. Extending obliquely from face 14B are a pair of rear distal faces 140.

The pair of forward cutting edges 14D extend obliquely from front face 14A. Elements 14C and 14D are slanted rearwardly.

Figure 6:
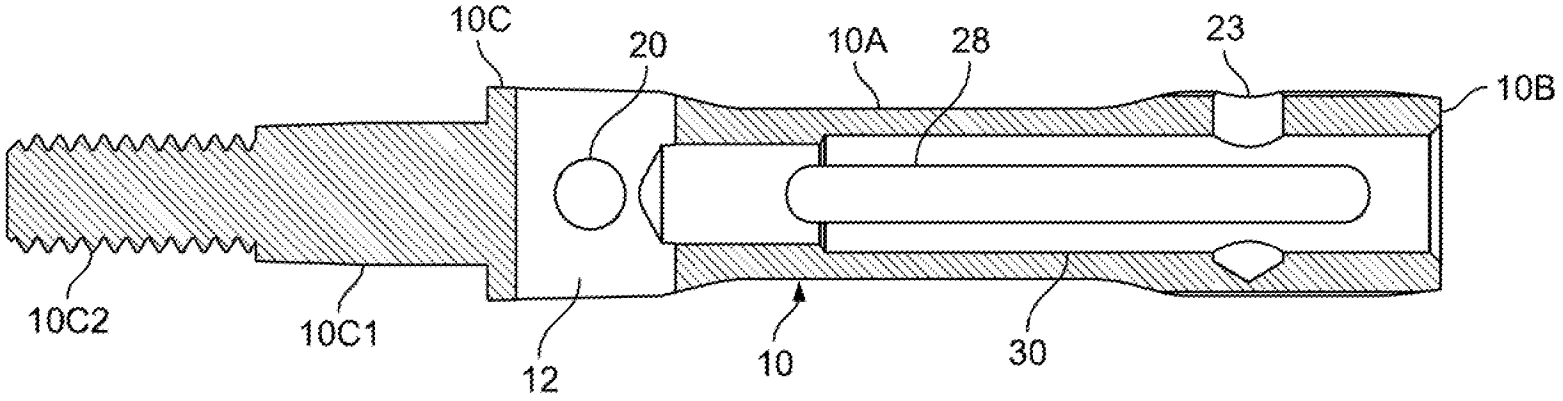
FIG. 6 is longitudinal-sectional side view of the body of FIG. 1.

Blade 14 is secured in slot 12 with a set screw (not shown), which passes through center hole 18 (FIG. 2) and is screwed into threaded blind hole 20 (FIG. 6).

Figure 3:
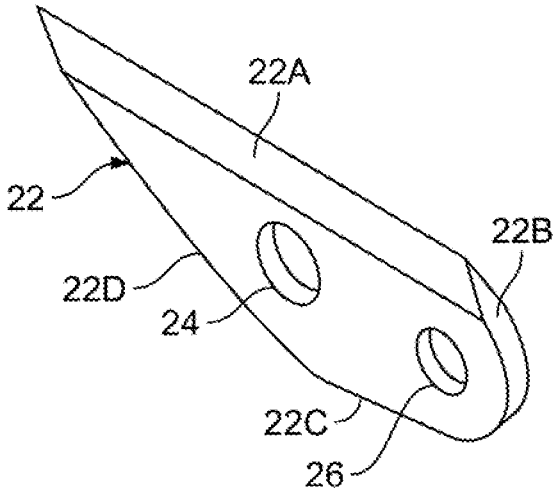
FIG. 3 is a perspective view of one of the articulating blades of FIG. 1.
Figure 4:
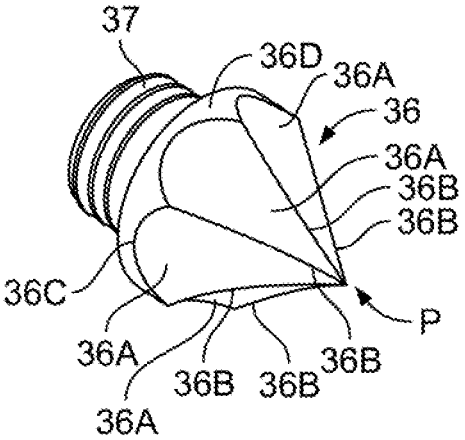
FIG. 4 is a perspective view of the tip of FIG. 1.
Figure 5:
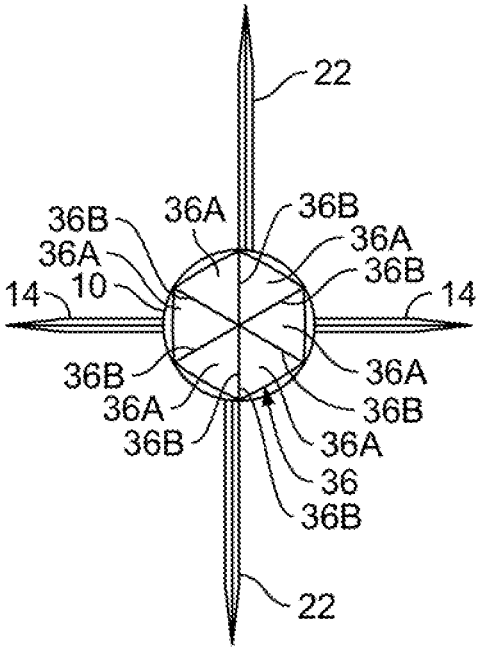
FIG. 5 is a front view of the apparatus of FIG. 1.

Midsection 10A has an opposite pair of slots 28, spaced 180° apart (FIGS. 1 and 6) that almost reach to the forward end of body 10. A parallel pair of articulating blades 22 project through slots 28 in opposite directions. Axle 21 (FIG. 1) is screwed into threaded hole 23 (FIG. 6) in forward end 108 and through the blades' journal aperture 26 (FIG. 3). Accordingly, axle 21 functions as a common axis for both of the articulating blades 22. Axle 21 is shown intersecting one of the flutes 23.

Each of the articulating blades 22 has a sharpened leading edge 22A and a trailing edge 22D. Each of the blades 22 has a rounded proximal end 22B and an intervening edge 22C. Edge 22C connects between trailing edge 22D and rounded end 22B.

In FIGS. 1 and 6 body 10 has a longitudinal cavity 30 containing a spherical ball 32 that is urged forward by helical spring 34. Ball 32 and spring 34 are together referred to as a resilient device. Ball 32 acts as a pushing element that bears against trailing edges 22D of each of the adjacent, side-by-side blades 22. Trailing edge 22D acts as a camming surface allowing ball 32 to push blades 22 outwardly to the extended position shown in FIG. 1. Spring 34 has a preloaded force of, for example, 48 pounds, which assures that blades 22 stay deployed unless a serious obstacle is encounted at a target. As blades 22 retract and compress spring 34, the spring will exert additional force, for example, 90 pounds of force. These forces can be different in different embodiments.

In this embodiment spring 34 has an elastic limit of, for example, 100 pounds. When encountering a compression force of 100 pounds or more, spring 34 will quickly compress while sustaining extreme force. As a result, the spring will undergo inelastic deformation, which will limit the amount of force that the spring can offer. While this deformation sacrifices the spring, it is important to avoid breaking off blades 22, which can lodge in the animal causing a non-lethal wound leading to extended suffering.

Figure 7:
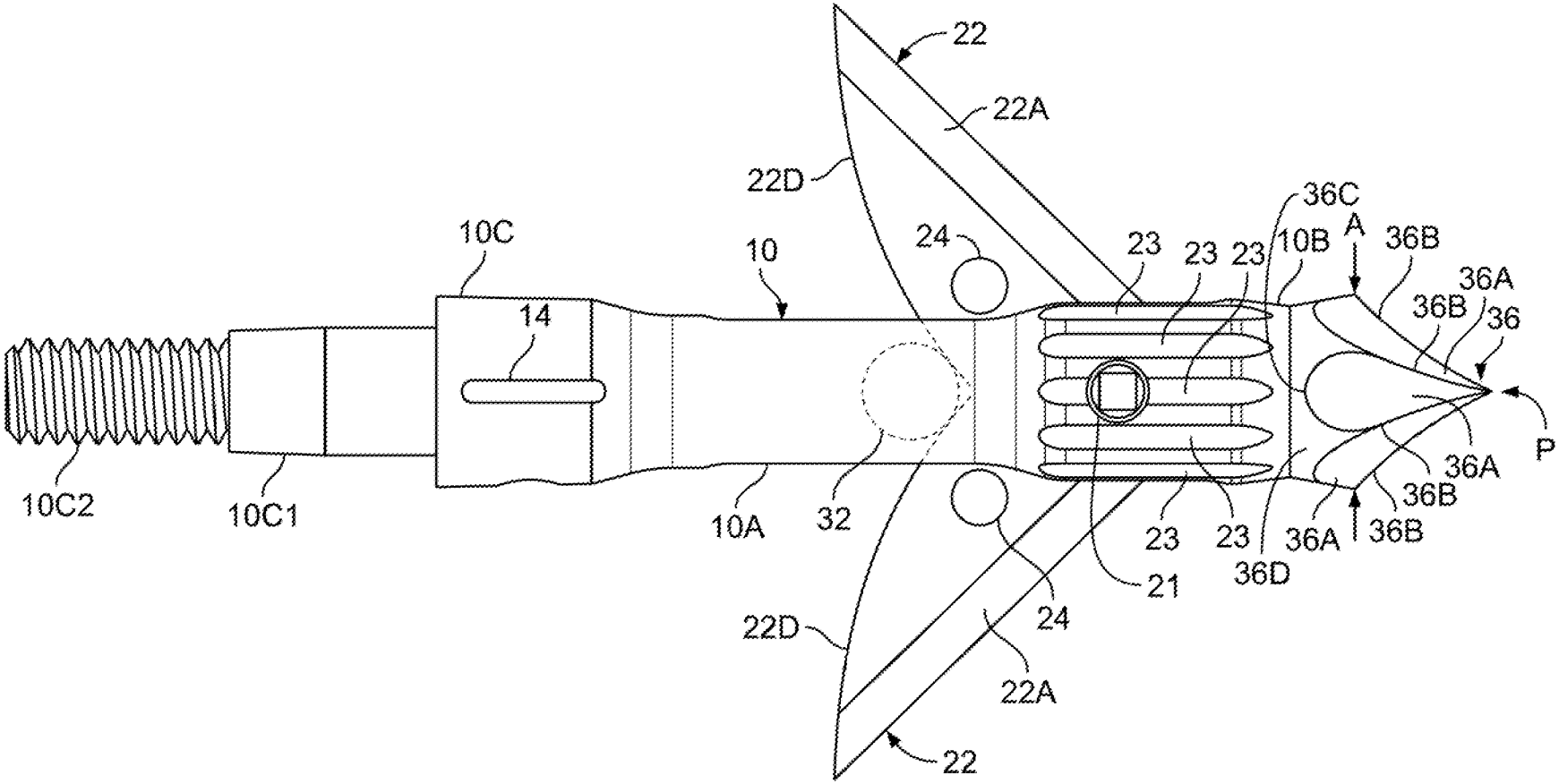
FIG. 7 is a side view of the apparatus of FIG. 1.

Tip 36 has a threaded stud 37 (FIG. 4) that screws into the forward end of body 10 (FIG. 1). Tip 36 has six funnel-shaped, concave flutes 36A forming six sharp edges 36B. Edges 36B are designed to fracture or shatter hard tissue (e.g., bones or bony structure). For efficient operation, it is desirable to have four or more sharp edges, but excellent results can be achieved by employing at least six sharp edges. In fact, the number of flutes can be even greater and may be chosen based on considerations of strength, function, appearance, etc. Because the number of sharp edges in the tip may be a personal preference of the archer, tip 36 may be unthreaded from body 10 and replaced with a different tip having a different number of sharp edges. In addition, tip 36 can be selected to have a desired "weight forward." In general, a heavier tip will increase the weight forward and enhance the punch delivered by the broadhead. In some embodiments tip 36 can be selected to give the broadhead an overall weight of 100 grains or 125 grains, FIG. 7 shows the maximum width (or diameter) of tip 36 as dimension A. Dimension A is greater than the width (or diameter) of body 10, so that tip 36 creates a passage bigger than body 10, facilitating its passage through a target. In this embodiment, dimension A is approximately 0.33 inch, although this dimension may be different in different embodiments. It is desirable to have dimension A at least 5% greater than the width (or diameter) of body 10. The relatively greater width of dimension A will reduce the frictional drag caused by the following structure and enhance the energy at tip 36. To give an archer greater control over this drag, tip 36 can be replaced with another tip having a dimension A that is greater or less than 0.33 inch.

Aerodynamic drag is also a factor before tip 36 penetrates a target. For this reason, tip 36 flares outwardly to a rear border 10C to cause an airflow that reduces aerodynamic drag on the narrower body 10 lying past the tip.

The overall effectiveness of the arrow is enhanced if virtually all of its kinetic energy can be initially applied through the cutting edges 36B of the tip 36. Applying high amounts of energy through tip 36 enhances the ability to shatter bone and allow deep penetration of the arrow. However, the energy available at the tip can be degraded if portions of the arrow behind tip 36 produce a frictional drag. Accordingly, disclosed embodiments of the arrow have rearward portions that are relatively narrow and can easily pass through a target without producing frictional drag that saps the energy available at tip 36.

In fact, tip 36 itself has features for reducing drag. Flutes 36A originate at a common forward point P and diverge rearwardly from that point to form slanted scoops that end in scalloped border 36C. Beyond scalloped border 36C tip 36 has an inwardly tapered skirt 36D. Skirt 36D has a crown-like shape, that is, a flared waist with multiple peaks that are located at the proximal ends of cutting edges 36B. The inward tapering of skirt 36D eliminates unnecessary frictional drag beyond cutting edges 368. In fact, the cutting edges 36B of tip 36 produce a passage through which skirt 36D can easily pass. Accordingly, energy is not diverted from the cutting edges 36B of tip 36.

For the same reasons, both the forward section 10B and the rear section 10C, as well as a mid section 10A, have a width (not counting the blades) that is less than the maximum width A of tip 36. Again, tip 36 provides a passage through which body 10 easily passes without creating a drag that diverts energy from the cutting edges 36B of tip 36 or from blades 22 and 14.

To eliminate drag more effectively, rear section 10C and midsection 10A each have a smaller diameter than forward section 10B, and can therefore pass easily through the passage produced by tip 36 and by forward section 10B.

In FIG. 7 blades 22 are shown each extending approximately the same given amount. In this embodiment, each of the blades 22 extend 0.75 inch from the centerline of body 10. This given amount of extension is greater than the maximum extension of fixed blade 14, which in this embodiment is 0.44 inch (that is, the tip to tip dimension of blade 14 is 0.88 inch). The length of blades 22 and 14 and the magnitude of their extension is not constrained in the present invention and can be different in different embodiments. The blade size may be selected based on considerations of mechanical strength, portability, lethality, appearance, etc.

Figure 8:
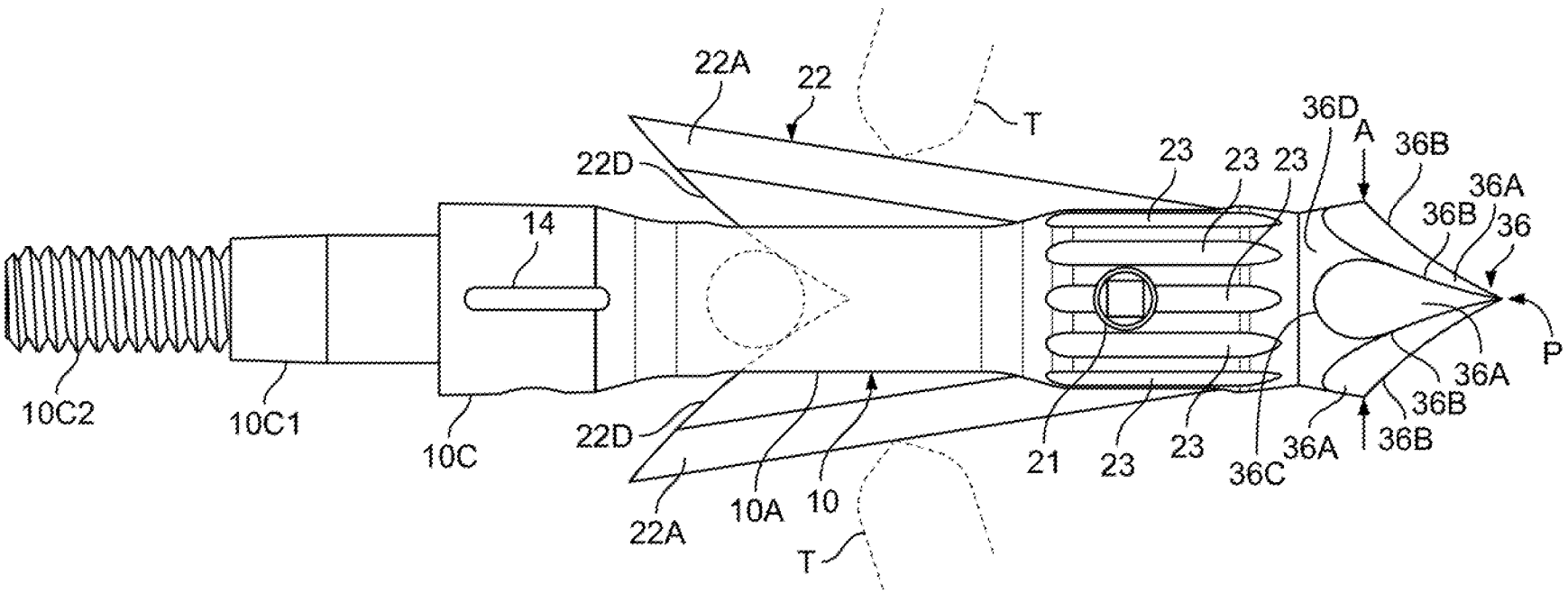
FIG. 8 is a side view of the apparatus of FIG. 7 showing the articulating blades folded backwardly.

Referring to FIG. 8, blades 22 have been pressed deeper into slots 18 to take a backwardly folded position, where each of the blades 22 extend approximately the same predetermined amount. In this embodiment blades 22 extend 0.59 inch (i.e., each of the folded blades 22 extend 0.295 inch from the centerline of body 10). Thus, this predetermined amount of extension (0.59 inch) is less than the maximum extension of blade 14 (i.e., less than 0.88 inch). Again, the amount of extension may be different in different embodiments.

It will be noted that the amount of blade retraction (i.e., from 1.5 inches to 0.59 inch) is rather liberal and enhances the ability of the device to deeply penetrate in spite of obstacles encountered at a target. On the other hand retraction to 0.59 inch is less than the minimum required by many jurisdictions to ensure a quick and humane dispatch of a game animal. In many jurisdictions the minimum blade span is 0.75 inch, but that minimum is satisfied by the fixed blades 14, whose tip to tip extension is 0.88 inch.

To facilitate an understanding of the principles associated with the foregoing apparatus, its operation will be briefly described. Before launching an arrow, threaded stub 10C2 is screwed into the main arrow shaft 20 (FIG. 1). At this time, spring 34 presses ball 32 against the trailing edges 22D of articulating blades 22 to push them into the extended positions shown in FIGS. 1, 5, and 7.

An archer may now use the string of an archery, bow (not shown) in the usual fashion to launch an arrow that will be carrying the device of FIG. 1. In unimpeded flight, ball 32 remains pressed against the trailing surfaces 22D, keeping blades 22 in the extended position.

During flight, aerodynamic drag is kept, low by the shape of tip 36. Tip 36 flares outwardly to rear border 36C to cause an airflow that reduces aerodynamic drag on the narrower body 10 lying past the tip.

Flying ahead of body 10, tip 36 eventually encounters and penetrates a target. The width A of tip 36 is relatively large and creates a passage facilitating the entry of body 10 into the target. In addition, tip 36 can be selected to have a desired "weight forward." In general, a heavier tip will increase the weight forward and enhance the punch delivered by the broadhead.

Eventually the proximal portions of cutting edges 22A of blades 22 dig into the target. In their extended positions, blades 22 produce a relatively large puncture wound that can quickly dispatch a game animal.

In some instances, the arrow will encounter hard tissue such as bones or other bony structure. In these circumstances, the sharp edges 36B of tip 36 will broach this bony structure by shattering or otherwise fragmenting this bony structure, which structure is identified in FIG. 8 as hard tissue T. The wide portion of tip 36 located at dimension A allows the forward portions of the tip to clear an ample path for passage of inwardly tapered skirt 36D, which is basically narrower than (no more than) maximum dimension A. Accordingly, penetration of the crown-shaped skirt 36D will not substantially dissipate energy and will concentrate the arrow's energy at cutting edges 36B.

The initial broaching of hard tissue T facilitates the entry of body 10, and eases subsequent passage of sections 10A, 10B, and 10C through the hard tissue. Also, because forward section 10B is wider than midsection 10A and rear section 10C, forward section 10B will plough through hard tissue T to prepare for and ease the subsequent passage of sections 10A and 10C.

Blades 22 will not easily penetrate if they remain in the extended position of FIG. 7. Accordingly, the resistance of hard tissue T will depress articulating blades 22, causing them to fold backwardly and to descend into slots 28 as shown in FIG. 8. In particular, the ramming action of trailing edges 22D will push back ball 32 (FIG. 1) and compress spring 34. As a result, the folded blades 22 will have a shallow, wedge-like effect and will penetrate deeply into the target, and thereby create a bigger passage for the rest of the arrow.

Spring 34 has a an elastic limit that prevents damage to the articulating blades 22. When encountering hard tissue such as a rib, moderate force is applied to blades 22, which quickly fold. If blades 22 encounter tissue that is extremely hard (e.g. a femur), an extreme force is instantaneously applied through the blades to the spring 34. The spring 34 will quickly compress but will sustain extreme force. As a result, spring 34 will undergo inelastic deformation, which will limit the amount of force that the spring can offer. While this deformation sacrifices the spring 34, it is important to avoid breaking off blades 22, which can lodge in the animal causing a non-lethal wound, leading to extended suffering.

Assuming blades 20 are not facing extreme conditions and do not break off, eventually, blades 22 will pass by the hard tissue T of FIG. 8. This relieves the downward pressure on blades 22 and allows them to return to the fully extended position of FIGS. 1 and 7. Specifically, spring 34 will press ball 32 forwardly, which will produce a camming action on the trailing edges 22D of blades 22. With blades 22 now extended, their cutting edges 22A can produce a relatively large puncture wound that will quickly dispatch a game animal.

As body 10 continues to penetrate the target, eventually cutting edges 14D of fixed blades 14 will penetrate the target to increase the lethality of the device. It will be noticed that fixed blades 14 have a wider expanse than articulating blades 22 when they are in the folded position of FIG. 8. This feature can be important in, jurisdictions that require the Broadhead blades to maintain a certain width to ensure a rapid and humane kill.

Figure 9:
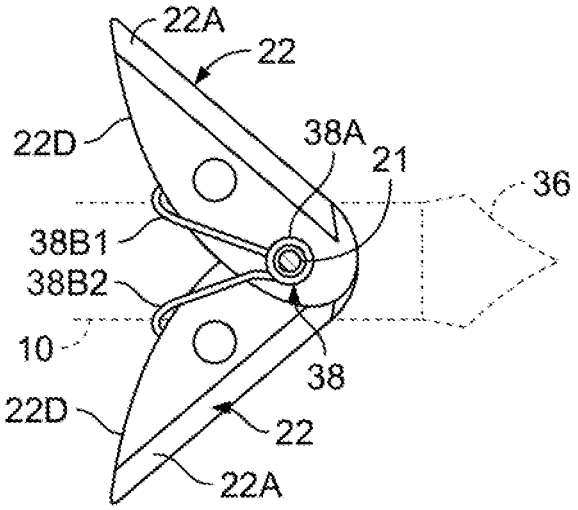
FIG. 9 is a side view of articulating blades and a resilient device that is an alternative to that shown in FIG. 1.

Referring to FIG. 9, previously mentioned articulating blades 22 are shown pivotally mounted on previously mentioned axle 21 (shown in cross-section). The previously mentioned tip 36 and body 10 are shown in phantom.

In this embodiment, the previously described ball and spring (ball 32 and spring 34 of FIG. 1) have been replaced with torsion spring 38, which acts as an alternate resilient device. Torsion spring 38 has a helical winding 38A positioned around the common axis provided by axle 21. Winding 38A terminates in a pair of arms 38B1 and 38B2, whose distal ends are formed into hooks that engage trailing edges 22D of this given pair of articulating blades 22.

In operation, torsion spring 38 urges articulating blades 22 to the extended positions shown in FIG. 9. In a manner similar to that previously described, blades 22 can fold backwardly upon encountering hard tissue. Specifically, arms 38B1 and 38B2 will swing together to wind helical winding 38A more tightly. At the same time the hooks on arms 38B1 and 38B2 will slide back over trailing edges 22D, thereby allowing blades 22 to fold backwardly. Again, blades 22 can return to the extended position after passing by the hard tissue. Spring 38 may also have an elastic limit that prevents blades 22 from breaking off and causing extended suffering.

Figure 10:
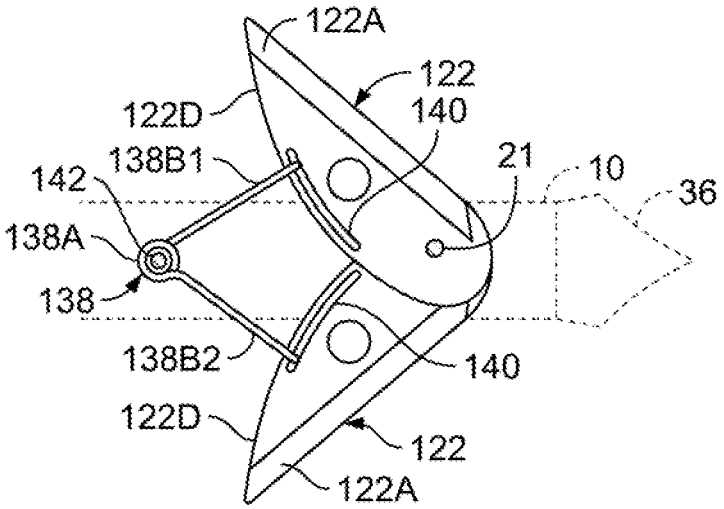
FIG. 10 is a side view of articulating blades and a resilient device that is an alternative to that shown in FIGS. 1 and 9.

Referring to FIG. 10, previously mentioned articulating blades 22 have been replaced with articulating blades 122. Features of blades 122 that correspond to those previously illustrated have the same reference numbers but increased by 100. Blades 122 are shown pivotally mounted on previously mentioned axle 21 (shown in cross-section). The previously mentioned tip 36 and body 10 are shown in phantom.

In this embodiment, the previously described torsion spring (torsion spring 38 of FIG. 9) has been replaced with torsion spring 138, which acts as an alternate resilient device. Features of spring 138 that correspond to those previously illustrated have the same reference numbers but increased by 100.

Torsion spring 138 has a helical winding 138A located aft of trailing edges 122D. Helical winding 138A terminates in a pair of arms 138B1 and 138B2, whose distal ends are formed into hooks that engage longitudinal slots 140 located alongside the trailing edges 122D of blades 122.

Winding 138A is shown encircling a shaft 142, shown in cross-section. Shaft 142 may terminate on either end in a circular flange, or may have another barbell-like shape. The ends of shaft 142 may slide in the previously mentioned longitudinal cavity of body 10 (cavity 30 of FIG. 6).

In operation, torsion spring 138 urges articulating blades 122 to the extended positions shown in FIG. 10. In a manner similar to that previously described, blades 122 can fold backwardly upon encountering hard tissue. Specifically, arms 138B1 and 138B2 will swing together to wind helical winding 138A more tightly. At the same time the hooked ends of arms 138B1 and 138B2 will slide down in slots 140 while helical winding 138A and shaft 142 will shift rearwardly, thereby allowing blades 22 to fold backwardly. As before, blades 122 can return to the extended position after passing by the hard tissue. Spring 138 may also have an elastic limit that prevents blades 122 from breaking off and causing extended suffering.

Figure 11:
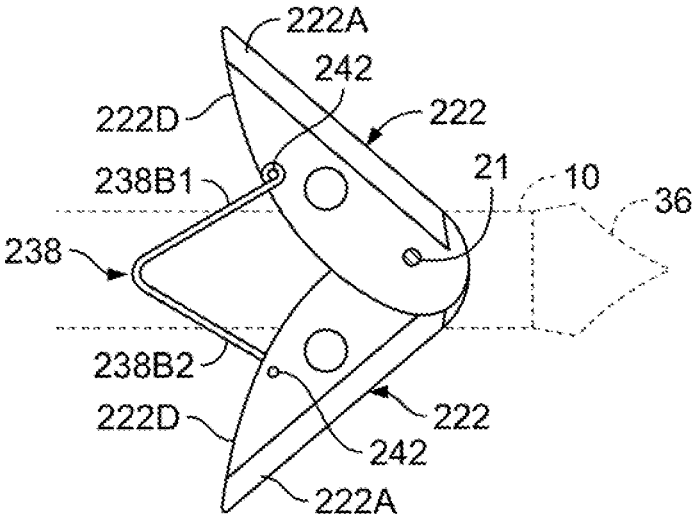
FIG. 11 is a side view of articulating blades and a resilient device that is an alternative to that shown in FIGS. 1, 9, and 10.

Referring to FIG. 11, previously mentioned articulating blades 22 have been replaced with a given pair of articulating blades 222. Features of blades 222 that correspond to those previously illustrated have the same reference numbers but increased by 200. Blades 222 are shown pivotally mounted on previously mentioned axle 21 (shown in cross-section). The previously mentioned tip 36 and body 10 are shown in phantom.

In this embodiment, the previously described torsion spring (torsion spring 38 of FIG. 9) has been replaced with bow spring 238, which acts as an alternate resilient device. Features of spring 238 that correspond to those previously illustrated in FIG. 9 have the same reference numbers but increased by 200.

Bow spring 238 lacks a helical winding and is essentially a V-shaped spring with an angled pair of arms 238B1 and 238B2, whose opposite, distal ends are wrapped around posts 242 located alongside the trailing edges 222D of blades 222.

In operation, bow spring 238 urges articulating blades 222 to the extended positions shown in FIG. 11. In a manner similar to that previously described, blades 222 can fold backwardly upon encountering hard tissue. Specifically, arms 238B1 and 238B2 will swing together while the apex of bow spring 238 will shift rearwardly, thereby allowing blades 222 to fold backwardly. As before, blades 222 can return to the extended position after passing by the hard tissue. Spring 238 may also have an elastic limit that prevents blades 222 from breaking off and causing extended suffering.

It is appreciated that various modifications may be implemented with respect to the above described embodiments. While two articulating blades are illustrated, other embodiments may employ a different number of articulating blades. The disclosed articulating blades have a substantially straight cutting edge, but other embodiments may employ a cutting edge that is curved, serrated, spiraled, etc. The amount of spring force used to deploy the articulating blades can be varied depending upon the nature of the intended target. Also, the spring can be designed with various elastic limits that are appropriate for the intended target. The range of the angular swing of the articulating blades can be varied depending on the target and whether one wishes to keep the blades extended more or less than illustrated. The disclosed articulating blades are mounted on a common axle but separate axles may be used in other embodiments. The disclosed body that holds the articulating blades may be made of steel or other metals, or in some cases may be made of plastic, composite material, etc. While a single rear, fixed blade with opposite extensions is disclosed, other embodiments may have separate multiple blades or blades with segments that extend only in one direction. The disclosed tip was illustrated with straight cutting edges, but in other embodiments these edges can be curved, serrated, spiralled, etc. The disclosed tip is made of steel but other embodiments may employ different metals or other materials having a strength sufficient to fracture hard tissue.

Obviously, many modifications and variations of the present invention are possible in light of the above teachings. It is therefore to be understood that within the scope of the appended claims, the invention may be practiced otherwise than as specifically described.

The invention claimed is:

1. Apparatus for broadhead archery, comprising:

an interchangeable tip having a plurality of edges adapted to penetrate hard tissue;

a body having a forward end and an aft end, the tip being located on the forward end;

a plurality of articulating blades pivotally mounted on the body to swing between an extended position and a backwardly folded position;

a resilient device for keeping the plurality of articulating blades in the extended position during unimpeded flight and afterward until the articulating blades encounter hard tissue in a target, the resilient device allowing the articulating blades to fold backwardly in response to the articulating blades encountering hard tissue in a target, the resilient device allowing the articulating blades to swing toward the extended position after traveling past hard tissue in the target; and one or more longitudinally and angularly fixed blades mounted on the body behind the plurality of articulating blades, wherein the tip has a maximum width exceeding that of the body and a maximum diameter exceeding that of the body by at least 5%.

2. Apparatus for broadhead archery, comprising:

an interchangeable tip having a plurality of edges adapted to penetrate hard tissue;

a body having a forward end and an aft end, the tip being located on the forward end;

a plurality of articulating blades pivotally mounted on the body to swing between an extended position and a backwardly folded position;

a resilient device for keeping the plurality of articulating blades in the extended position during unimpeded flight and afterward until the articulating blades encounter hard tissue in a target, the resilient device allowing the articulating blades to fold backwardly in response to the articulating blades encountering hard tissue in a target, the resilient device allowing the articulating blades to swing toward the extended position after traveling past hard tissue in the target; and one or more longitudinally and angularly fixed blades mounted on the body behind the plurality of articulating blades, wherein each of the articulating blades has a leading edge and a trailing edge, the body having a longitudinal cavity, the resilient device being mounted in the longitudinal cavity, the resilient device comprising:

a pushing element; and a spring for pressing the pushing element against the trailing edge of each of the articulating blades, wherein the pushing element is bulging and the spring is helical.

3. Apparatus for broadhead archery, comprising:

an interchangeable tip having a plurality of edges adapted to penetrate hard tissue;

a body having a forward end and an aft end, the tip being located on the forward end;

a plurality of articulating blades pivotally mounted on the body to swing between an extended position and a backwardly folded position;

a resilient device for keeping the plurality of articulating blades in the extended position during unimpeded flight and afterward until the articulating blades encounter hard tissue in a target, the resilient device allowing the articulating blades to fold backwardly in response to the articulating blades encountering hard tissue in a target, the resilient device allowing the articulating blades to swing toward the extended position after traveling past hard tissue in the target; and one or more longitudinally and angularly fixed blades mounted on the body behind the plurality of articulating blades, wherein the resilient device comprises:

a torsion spring having helical winding and a pair of arms extending from the helical winding to connect to a given pair of the plurality of articulating blades.

4. Apparatus according to claim 3 wherein the given pair of articulating blades have a pair of longitudinal slots, the pair of arms connecting to the pair of longitudinal slots.

5. Apparatus according to claim 3 wherein the given pair of articulating blades are mounted to pivot on a common axis, the helical winding being mounted around the common axis.

6. Apparatus according to claim 3 wherein the given pair of articulating blades each have a leading edge and a trailing edge, the helical winding being positioned aft of the trailing edges of the given pair of articulating blades.

* * * * *